US006106988A

United States Patent [19]

Furukawa et al.

[11] Patent Number: 6,106,988

[45] Date of Patent: Aug. 22, 2000

[54] TONER RESIN COMPOSITION AND TONER PREPARED THEREFROM

[75] Inventors: Toshiharu Furukawa; Takashi Ueyama, both of Kusatsu; Hiroaki Takehara, Shiga; Masazumi Okudo, Otsu, all of Japan

[73] Assignee: Sekisui Chemical Co., Ltd., Osaka, Japan

[21] Appl. No.: 09/247,553

[22] Filed: Feb. 10, 1999

[51] Int. Cl.[7] ..... G03G 9/00

[52] U.S. Cl. ..... 430/110

[58] Field of Search ..... 430/110

[56] References Cited

U.S. PATENT DOCUMENTS 5,814,429 9/1998 Kawakami et al. ..... 430/124

5,912,101 6/1999 Karaki et al. ..... 430/110

*Primary Examiner*—Mark Chapman

*Attorney, Agent, or Firm*—Arent Fox Plotkin Kintner Kahn

[57] ABSTRACT

A toner resin composition, as well as a toner prepared therefrom, are disclosed which are excellent in fixability, offset resistance and storage stability, and which result in reduced occurrence of DF staining.

The toner resin composition includes (a) a vinyl copolymer containing 25 or lower % by weight of molecular species having molecular weights of 200,000 or higher; and (b) 3 to 10% by weight of ethylene-based olefin polymer which has a DSC-determined peak (melting point) within a range of 85–100° C., a weight average molecular weight (Mw) within a range of 500–900, a number average molecular weight (Mn) within a range of 500–900, and a melt viscosity of 10 to 17 cps at 100° C.

5 Claims, No Drawings

TONER RESIN COMPOSITION AND TONER PREPARED THEREFROM

BACKGROUND OF THE INVENTION

1. Field of the Invention

The present invention relates to a toner resin composition for use in electrophotography or the like, and further to a toner prepared from the resin composition. More particularly, the present invention relates to a toner resin composition for use in a so-called dry development, one of methods which develop electrostatic latent images, and further to a toner prepared from the resin composition.

2. Description of Related Art

In an electrophotographic or similar field, the dry development has been widely used as one of the methods which develop electrostatic latent images. In the dry development process, toners are generally charged through frictional contact with so-called carriers such as iron particles or glass beads. The charged toners are then electrically attracted by and deposited on the electrostatic latent images produced on an electroreceptor. The produced toner images are transferred onto a paper and then fixed thereon, as by a heat roll, so that visual images are permanently provided.

For fixation of the toner images, a heat roll method is a popular choice which utilizes a heat roll having a surface coated with a substance that shows a release property relative to the toners. A paper onto which the toner images have been transferred is compressed against the heat roll so that they are thermally fixed on the paper.

In order to improve a process economy, e.g., reduction in power consumption, as well as to increase a copying speed, a toner resin for particular use in the heat roll method has been sought which can be fixed at temperatures lower than conventionally employed.

Also in the heat roll fixation method, a toner while in a molten state is compressively brought into contact with the heat roll surface. This results in the increased tendency for a portion of the toner to adhere to the heat roll surface from which the adhered toner portion is retransferred onto a subsequently-introduced paper, i.e., the increased occurrence of a so-called offset phenomenon.

One technique to restrain the occurrence of this offset phenomenon is the provision of a release coating, e.g., a silicone oil coating on the heat roll surface. This technique, however, problematically requires complex procedures and facilities for providing the release coating. A need has accordingly arisen for a toner resin which is excellent in offset resistance. The term "offset resistance", as used herein, refers to a toner property by which the offset phenomenon can be maintained at a reduced degree of occurrence.

A method to improve the offset resistance has been proposed, for example, in Japanese Patent Publication No. 52-3304 (1977) which utilizes a low molecular weight polypropylene as a release agent for inclusion in toners. While the inclusion of a release wax, such as polypropylene, in toners is certainly effective in enhancing the offset resistance, the use of polypropylene having a higher melting point undesirably leads to reduced fixability of the toners.

In an attempt to improve both fixability and offset resistance, toners have been proposed which contain a low molecular weight or low viscosity ethylene-based wax, for example, by Japanese Patent Laying-Open Nos. 07-36218 (1995) and 08-114942 (1996). In general, the inclusion of a wax in a toner not only improves its release property, but also results in a reduced occurrence of DF (document feeder) staining. However, the current state of the art has not yet reached to a satisfactorily effective level.

SUMMARY OF THE INVENTION

It is an object of the present invention to provide a toner resin composition which is excellent in fixability, offset resistance and storage stability and which results in reduced occurrence of DF staining. It is another object of the present invention to provide a toner prepared from the toner resin composition.

In accordance with a first aspect of the present invention, a toner resin composition is provided which contains a vinyl copolymer and an ethylene-based olefin polymer. The vinyl copolymer contains molecular species having molecular weights of 200,000 or higher in the amount not to exceed 25% by weight. The ethylene-based olefin polymer has a peak (melting point) within the temperature range of 85–100° C. as determined by DSC (differential scanning calorimeter), a weight average molecular weight (Mw) within the range of 500–900, a number average molecular weight (Mn) within the range of 500–900, and a melt viscosity of 10 to 17 cps at 100° C. The toner resin composition contains 3 to 10% by weight of the ethylene-based olefin polymer.

The aforementioned vinyl copolymer for use in the toner resin composition according to the first aspect preferably incorporates styrene and (meth)acrylic ester monomeric moieties therein.

Also, the aforementioned ethylene-based olefin polymer for use in the toner resin composition according to the first aspect may preferably be polyethylene.

In accordance with a second aspect of the present invention, a toner resin composition is provided which contains a vinyl copolymer, prepared primarily from a styrene monomer and a (meth)acrylic ester monomer, and an ethylene-based olefin polymer. The ethylene-based olefin polymer has a weight average molecular weight (Mw) within the range of 400–2,000, a melt viscosity of 5–1,000 cps at 120° C., a peak (melting point) within the temperature range of 75–110° C. as determined by DSC (differential scanning calorimeter), and a thermal property as defined by. $W1/W2 \geqq 1$ wherein W1 is a heat quantity absorbed by a unit amount of the polymer during its fusion (hereinafter referred to as an endothermic heat accompanying fusion) in the temperature region $\geqq Tm$, W2 is an endothermic heat accompanying fusion in the temperature region $<Tm$, and Tm is the aforementioned peak. The toner resin composition contains 3 to 10% by weight of the aforementioned ethylene-based olefin polymer.

In accordance with the second aspect of the invention, the aforementioned ethylene-based olefin polymer for use in the toner resin composition may preferably be polyethylene.

In accordance with a further aspect of the present invention, a toner is provided which principally contains the toner resin composition according to the first or second aspect of the invention and a colorant.

The vinyl copolymer, for use in the toner resin composition, according to the first aspect of the invention, contains 25 or lower % by weight of molecular species having molecular weights of 200,000 or higher, as determined by GPC (gel permeation chromatography).

The aforementioned molecular species having molecular weights of 200,000 or higher, if contained in the amount to exceed 25% by weight, act to reduce the fluidity of the resulting toner resin composition, leading to the increased occurrence of DF staining.

GPC, as used herein, refers to a gel permeation chromatography. Tetrahydrofuran (THF) was used as a solvent. A resin sample was dissolved in THF for 2 hours to a concentration of 0.2% by weight, and filtered through a 0.45 micrometer filter. A sample was injected at a volume of 100 microliter and eluted at a rate of 1 ml per minute through a column maintained at 40° C. The column employed was a Shodex Model KF-80M or KF-802.5.

Illustrative of the aforementioned vinyl copolymer is a copolymer which includes respective units of a styrene monomer and a (meth)acrylic ester monomer.

Examples of such styrene monomers include styrene, o-methylstyrene, m-methylstyrene, a-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyrene, and 3,4-dichlorostyrene.

Examples of the aforementioned (meth)acrylic ester monomers include alkyl esters of (meth)acrylic acid such as methyl (meth)acrylate, ethyl (meth)acrylate, propyl (meth) acrylate, n-butyl (meth)acrylate, isobutyl (meth)acrylate, n-octyl (meth)acrylate, dodecyl (meth) acrylate, 2-ethylhexyl (meth) acrylate, stearyl (meth)acrylate. Other suitable (meth)acrylic ester monomers are 2-chloroethyl acrylate, phenyl (meth)acrylate, methyl α-chloracrylate, 2-hydroxyethyl (meth)acrylate, 2-hydroxypropyl (meth) acrylate, 2-hydroxybutyl (meth)acrylate, glycidyl (meth) acrylate, dimethylaminoethyl methacrylate, diethylaminoethyl methacrylate, bis-glycidyl methacrylate, polyethylene glycol dimethacrylate, methacryloxyethyl phosphate. Among the above-listed (meth)acrylic ester monomers, particularly preferred are methyl methacrylate, ethyl (meth) acrylate, propyl (meth)acrylate, n-butyl (meth)acrylate, 2-ethylhexyl acrylate.

Useful monomers, other than the above-described styrene and (meth)acrylic ester monomers, are vinyl monomers which include acrylic acid, methacrylic acid, α-ethylacrylic acid and crotonic acid and α- or β-alkyl derivatives thereof; unsaturated dicarboxylic acids and mono or diester dereivatives thereof such as fumaric acid, maleic acid, citraconic acid and itaconic acid. Other useful vinyl monomers include mono(meth)acryloyloxyethyl succinate, (meth)acrylonitrile and acrylamide.

The vinyl copolymer for use in the first aspect may have a crosslinked structure. Alternatively, crosslink bonds may be introduced by the reaction thereof with a crosslinking agent.

Examples of useful bifunctional crosslinking agents include divinyl benzene, ethylene glycol di(meth)acrylate, 1,3-butylene glycol di(meth)acrylate, 1,4-butanediol di(meth)acrylate, 1,5-pentanediol di(meth)acrylate, 1,6-hexanediol di(meth)acrylate, diethylene glycol di(meth) acrylate, triethylene glycol di(meth)acrylate, tetraethylene glycol di(meth)acrylate, pentaethylene glycol di(meth) acrylate, di(meth)acrylate of polyethylene glycol #200, #400 or #600, dipropylene glycol di(meth)acrylate and polypropylene glycol di(meth)acrylate.

Examples of useful polyfunctional crosslinking agents include pentaerythritol tri(meth)acrylate, trimethylolethane tri(meth)acrylate, trimethylolpropane tri(meth)acrylate, tetramethylolmethane tetra (meth) acrylate, oligo ester (meth) acrylate, 2,2-bis(4-methacryloxy,polyethoxyphenyl) propane, diallyl phthalate, triallyl cyanurate, triallyl isocyanurate, triallyl trimellitate and diallyl chlorendate.

Examples of peroxide initiators for use in the copolymerization of the above-stated vinyl monomers include ketone peroxides such as methyl ethyl ketone peroxide, cyclohexanone peroxide, methyl acetoacetate peroxide and acetylacetone peroxide; peroxyketals such as 1,1-bis(tert-butylperoxy)- 3,3,5-trimethyl cyclohexane and n-butyl-4,4-bis(tert-butylperoxy) valerate; hydroperoxides such as tert-butyl hydroperoxide, cumene hydroperoxide, p-di-isopropylbenzene hydroperoxide and p-menthane hydroperoxide; dialkyl peroxides such as di-tert-butyl peroxide, tert-butylcumyl peroxide and dicumyl peroxide; diacyl peroxides such as acetyl peroxide, isobutyl peroxide, octanoyl peroxide, benzoyl peroxide and 2,4-dichlorobenzoyl peroxide; peroxydicarbonates such as di-isopropyl peroxydicarbonate, di-n-propyl peroxydicarbonate, dimethoxyisopropyl peroxydicarbonate and diallyl peroxydicarbonate; and peroxy esters such as tert-butyl peracetate, tert-butyl peroxypivalate, tert-butyl peroxybenzoate and cumyl peroxyoctoate.

Other useful peroxide initiators include acetyl cyclohexyl sulfonyl peroxide and di-tert-butyl peroxy hexahydroterephthalate. Azo intiators can also be employed.

Any technique which can copolymerize the vinyl monomers, i.e., synthesize the vinyl copolymer for use in the first aspect of the invention, may be utilized. Applicable techniques include, for example, suspension polymerization, emulsion polymerization, solution polymerization and bulk polymerization, respectively in the presence of the ethylene-based olefin polymer. Preferred is the solution polymerization in the presence of the ethylene-based olefin polymer. Also, the vinyl monomers can be solution copolymerized in the presence of both the ethylene-based olefin polymer and the vinyl copolymer previously synthesized by suspension, emulsion, solution or bulk polymerization.

The ethylene-based olefin polymer, for use in the first aspect of the present invention, has a DSC-determined peak (melting point) within the temperature range of 85–100° C., a weight average molecular weight (Mw) within the range of 500–900, a number average molecular weight (Mn) within the range of 500–900, and a melt viscosity of from 10 to 17 cps at 100° C.

Where the DSC-determined peak (melting point) is lower than 85° C., or where either Mw or Mn is below 500, the fixation of toner images results in the increased tendency for such an ethylene-based olefin polymer to be separated from the vinyl copolymer, rendering the toner fragile to result in the increased occurrence of DF staining.

Where the DSC-determined peak (melting point) is higher than 100° C., or where either Mw or Mn goes beyond 900, the desired improvement in fixability of the resulting toner is not obtained. If the melt viscosity of the ethylene-based olefin polymer at 100° C. falls below 10 cps, the resulting toner exhibits reduced dispersiability. On the other hand, if it goes beyond 17 cps, the resulting toner exhibits reduced fixability.

The toner resin composition according to the first aspect contains 3 to 10% by weight of the ethylene-based olefin polymer. The polymer content of lower than 3% by weight may lead to the reduced fixability of the resulting toner. On the other hand, the polymer content of higher than 10% may lead to the increased occurrence of DF staining.

The aforementioned ethylene-based olefin polymer for use in the toner resin composition according to the first aspect may be polyethylene, for example.

In the toner resin composition according to the first aspect of the present invention, the aforementioned vinyl copolymer may further be copolymerized with a suitable monomer such as vinyl acetate or vinyl chloride, within a permissible range to achieve the present invention. Alternatively, the toner resin composition may contain a polymerizate of such a monomer. Also, the toner resin composition may contain a resin having a GPC-determined weight average molecular weight of from 30,000 to 300,000. Illustrative of such resins are polyesters, epoxies, urethanes and vinyl resins. Aliphatic amides, bis(aliphatic)amides, metallic soaps and paraffins may also be contained in the toner resin composition.

The toner resin composition according to the second aspect of the present invention will be now explained.

The vinyl copolymer, for use in the toner resin composition according to the second aspect, is prepared principally from the styrene monomer and (meth)acrylic ester monomer. In view of aggregation, the vinyl copolymer preferably has a glass transition point of at least 50° C. It is also preferred that the vinyl copolymer has a softening point of not higher than 130° C.

The toner resin composition according to the second aspect of the invention can be obtained, for example, by mixing the aforementioned vinyl copolymer and ethylene-based olefin polymer and melt kneading the mixture by means of a roll mill, kneader, or extruder. A technique can also be employed which adds the ethylene-based olefin polymer at a stage either before or during or after copolymerization of the vinyl monomers. Applicable polymerization techniques include suspension polymerization, emulsion polymerization, solution polymerization and bulk polymerization. In view of less-complicated manufacturing recipes, a preferred choice is the solution polymerization wherein the ethylene-based olefin polymer is added prior to copolymerization of the vinyl monomers.

The aforementioned ethylene-based olefin polymer has a weight average molecular weight (Mw) within the range of 400–2,000, a melt viscosity of 5–1,000 cps at 120° C., a DSC-determined peak (melting point) within the temperature range of 75–110° C., and a thermal property as defined by $W1/W2 \geqq 1$ wherein W1 is a heat quantity absorbed by a unit mass of the ethylene-based olefin polymer during its fusion (may also be referred to as an endothermic heat accompanying fusion) in the temperature region $\geqq Tm$, W2 is an endothermic heat accompanying fusion in the temperature region $<Tm$, and Tm is the aforementioned peak.

If the DSC-determined peak (melting point) of the ethylene-based olefin polymer is less than 75° C., or if its weight average molecular weight (Mw) is smaller than 400, the storage stability of the resulting toner is adversely affected. On the other hand, if the DSC-determined peak (melting point) of the ethylene-based olefin polymer is higher than 110° C., or if its weight average molecular weight (Mw) is greater than 2,000, the desired improvement in fixability of the resulting toner is not achieved.

Also, if the melt viscosity of the ethylene-based olefin polymer at 120° C. falls below 5 cps, the dispersibility of the resulting toner is reduced. On the other hand, if it goes beyond 1,000 cps, the desired improvement in fixability thereof is not obtained.

Furthermore, if W1/W2 falls below 1, the reduced offset resistance of the resulting toner may result.

The toner resin composition according to the second aspect contains 3 to 10% by weight of the aforementioned ethylene-based olefin polymer. If the olefin polymer content of the toner resin composition falls below 3% by weight, the desired improvement in offset resistance and fixability of the toner resulting therefrom may not be achieved. On the other hand, if it goes beyond 10% by weight, the fluidity of resulting toner may be adversely affected.

A toner of the present invention can be manufactured by dispersively adding a colorant, a charge control agent and a magnetic powder, if needed, to the toner resin composition according to the first or second aspect of the invention, melt kneading the mixture, and thereafter milling or grinding the kneaded mixture.

Examples of the aforementioned colorants include carbon black, aniline black, phthalocyanine blue, quinoline yellow, lamp black, rhodamine B and quinacridone. In general, such a colorant is added in the amount from 1 to 10% by weight, based on the toner resin composition weight.

The aforestated charge control agent has two types; one type for imparting a positive chargeabililty and another for imparting a negative chargeability. Examples of the charge control agents for imparting the positive chargeability include nigrosine dyes, ammonium salts, pyridinium salts and azines. Examples of the charge control agents for imparting the negative chargeability include metal complexes as of Cr and Fe. Such a charge control agent is added generally in the amount from 0.1 to 10% by weight, based on the toner resin composition weight.

Release properties have been conventionally introduced into toners, during manufature thereof, by mixing therewith a release agent such as a polypropylene wax and melt dispersing the mixture. However, the present invention can eliminate a need to use such a polypropylene wax or the like, since the presence of the ethylene-based olefin polymer contained in the toner resin composition of the present invention is effective in imparting satisfactory release properties to toners prepared from the toner resin composition.

EXAMPLES

The following examples illustrate the present invention but are not intended to be limiting thereof. All parts in the examples are by weight unless otherwise specified.

Example 1

(a) Preparation of a toner resin composition 70 parts of styrene was copolymerized with 30 parts of n-butyl acrylate to provide a vinyl copolymer, a maximum value of its molecular weight being 1 million. 22 parts of the vinyl copolymer, 4 parts of polyethylene "A" having physical properties indicated in Table 1, as an ethylene-based olefin polymer, and 100 parts of toluene were charged into a flask for dissolution thereof. An interior of the flask was nitrogen substituted, followed by heating to a boiling point of toluene. The solution was agitated under reflux of toluene. Concurrently, a liquid-form mixture of 65 parts of styrene, 13 parts of n-butyl acrylate and 3.4 parts of benzoyl peroxide (initiator) was added dropwise to the solution over 3 hours to effect solution polymerization.

After completion of the dropwise addition, maturing was continued for 1 hour under agitation and reflux of toluene to obtain a low molecular weight polymer having a maximum molecular weight of 10,000. Thereafter, an interior temperature of the flask was gradually elevated to 180° C., while desolvating toluene under vacuum, to obtain a toner resin composition (i). The toner resin composition (i) thus obtained was determined by GPC as containing 20% by weight of molecular species having molecular weights of 200,000 or higher.

(b) Preparation of a toner

The toner resin composition (i) above obtained was utilized to prepare the following blend which contained, by weight, 100 parts toner resin composition (i)

1.5 parts chrome complex dye ("S-34", name used in trade and manufactured by Orient Chem. Ind. Co., Ltd.)

6.5 parts carbon black ("MA-100", name used in trade and manufactured by Mitsubishi Kasei Co., Ltd.).

The blend thus prepared was melt mixed at 150° C. and then finely pulverized by a jet mill into toner particles having an average particle size of about 10 μm, to which 0.3 parts by weight of a hydrophobic silica ("R972", name used in trade and manufactured by Nippon Aerosil Co., Ltd.) was subsequently added to obtain a toner (I).

Example 2

The procedure of Example 1 was repeated, except that the polyethylene "A" was added in the amount of 9 parts, instead of 4 parts, to obtain a toner resin composition (ii) and a toner (II).

Example 3

The procedure of Example 1 was repeated, except that the polyethylene "A" was replaced by a polyethylene "B" having the physical properties as indicated in Table 1, to obtain a toner resin composition (iii) and a toner (III).

Comparative Example 1

The procedure of Example 1 was repeated, except that the polyethylene "A" was replaced by a polyethylene "C" having the physical properties as indicated in Table 1, to obtain a toner resin composition (iv) and a toner (IV) for comparative purposes.

Comparative Example 2

The procedure of Example 1 was repeated, except that the vinyl copolymer and the polyethylene "A" were added in the amount of 42 parts and 9 parts, respectively, instead of 22 parts and 4 parts, to obtain a toner resin composition (v) and a toner (V) for comparative purposes. The toner resin composition (v) was determined by GPC as containing 30% by weight of molecular species having molecular weights of 200,000 or higher.

Comparative Example 3

The procedure of Example 1 was repeated, except that the polyethylene "A" was added in the amount of 1.2 parts, instead of 4 parts, to obtain a toner resin composition (vi) and a toner (VI).

Comparative Example 4

The procedure of Example 1 was repeated, except that the polyethylene "A" was added in the amount of 25 parts, instead of 4 parts, to obtain a toner resin composition (vii) and a toner (VII).

The toners thus obtained were evaluated for fixability, offset resistance, storage stability and a degree of DF staining, according to the following test procedures.

(1) Fixability

Each toner (6.5 parts) was mixed with an iron powder carrier (93.5 parts) having a particle size in the approximate range of 50–80 μm to prepare a developer. This developer was utilized to produce plural unfixed images. A surface temperature of a heat-fixing roll was raised to 150 or 170° C. The unfixed image was transferred onto a paper to produce thereon a toner image which was subsequently heat fixed. An electrophotographic copy machine employed was a modified unit of "SF-9800", commercially available from Sharp Corp. The fixed image was then rubbed with a cotton pad to evaluate its fixed strength, indicative of a low-energy fixability. The fixed strength was calculated as follows:

$$\text{Fixed strength } (\%) = D_1/D_2 \times 100$$

where, $D_1$=density of fixed image after being rubbed; and $D_2$=density of fixed image before being rubbed.

The image density was determined by using a reflex densitometer "RD-914" manufactured by Macbeth Co., Ltd.

(2) Offset-resistance

A surface temperature of the heat-fixing roll was changed stepwise to different temperatures. At each surface temperature, an unfixed image was transferred onto a paper to produce thereon a toner image which was subsequently heat fixed to provide a copied image, and a marginal portion of the paper was observed if stained by the toners. A temperature region over which no staining was observed was specified as a non-offset temperature region. Also, a difference between maximum and minimum values in the non-offset temperature region was specified as a non-offset temperature range.

(3) Storage stability 20 g of each of the above-prepared toners (I) through (VII) was loaded in a 150 cc glass bottle which was subsequently left to stand for 48 hours in a constant temperature bath controlled at 50° C., to visually observe the occurrence of cake formation in the toner.

(4) Degree of DF staining

In the same manner as in the above-described fixability test, an unfixed image was transferred onto a paper to produce thereon a toner image which was subsequently fixed at 170° C. to provide a copied image. A back side of another transfer paper was placed onto the copied image and rubbed with a 100 g load. The back side was then visually observed if stained. The staining characteristics of the toners were classified into 5 levels. The highest level 1 was given to the toner which exhibited a superb result, i.e., the lowest degree of DF staining. The lowest level 5 was given to the toner which exhibited the poorest result, i.e., the highest degree of DF staining.

The following Tables 1 and 2 give the physical properties of the polyethylenes "A"–"C" and the results of the above-described tests, respectively.

TABLE 1

| SAMPLE DESIGNATION | M.P.* (°C.) | Mw | Mn | MELT VISCOSITY at 100° C. (cps) |
|---|---|---|---|---|
| A | 87 | 727 | 683 | 12 |
| B | 95 | 777 | 746 | 17 |
| C | 71 | 428 | 357 | 7 |

*DSC-DETERMINED MELTING POINT

TABLE 2

| | NON-OFFSET TEMP. REGION (° C.) | NON-OFFSET TEMP. RANGE (° C.) | FIXED STRENGTH (%) 150° C. | FIXED STRENGTH (%) 170° C. | STORAGE STABILITY | DF STAINING |
|---|---|---|---|---|---|---|
| Exp. No. | | | | | | |
| 1 | 145–210 ↑ | 65 ↑ | 66 | 82 | GOOD | 2 |
| 2 | 140–210 ↑ | 70 ↑ | 70 | 88 | GOOD | 1 |
| 3 | 145–210 ↑ | 65 ↑ | 61 | 80 | GOOD | 1 |
| COMP. Exp. No. | | | | | | |
| 1 | 140–210 ↑ | 45 ↑ | 67 | 83 | GOOD | 3 |
| 2 | 170–210 ↑ | 40 ↑ | — | 50 | GOOD | 5 |
| 3 | 150–210 | 60 | 47 | 60 | GOOD | 4 |
| 4 | 140–210 ↑ | 70 ↑ | 75 | 90 | CAKE FORMED | 1 |

("↑" REPRESENTS "or HIGHER")

As can be appreciated from Table 2, the toner resin compositions and toners, as prepared in Examples 1 through 3, all demonstrated excellent characteristics including fixability, offset resistance and storage stability, as well as reduced degrees of DF staining. In contrast, the toner (IV) of Comparative Example 1 showed an increased degree of DF staining, since the vinyl-based olefin polymer, i.e., polyethylene "C" contained therein had a melting point and a molecular weight lower than those of the polyethylenes "A" and "B". The toner (V) of Comparative Example 2 exhibited inferior fixability and the highest degree of DF staining, since molecular species having molecular weights of higher than 200,000 exceeded 25% of the total weight of the vinyl copolymer as incorporated in the toner resin composition (v) of Comparative Example 2.

The toner (VI) of Comparative Example 3 exhibited an increased degree of DF staining, since the ethylene-based olefin polymer content of the toner resin composition (vi) was lower than 3% by weight. The toner (VII) of Comparative Example 4 showed an reduced degree of DF staining but an inferior storage stability, since the ethylene-based olefin polymer content of the toner resin composition (vii) exceeded 10% by weight.

Example 4

The procedure of Example 1 was repeated, except that the polyethylene "A", as the ethylene-based olefin resin, was replaced by a polyethylene "D" having the physical properties as indicated in Table 3, to obtain a toner resin composition (viii) and a toner (VIII).

Example 5

The procedure of Example 1 was repeated, except that the polyethylene "A", as the ethylene-based olefin resin, was replaced by a polyethylene "E" having the physical properties as indicated in Table 3, to obtain a toner resin composition (ix) and a toner (IX).

Example 6

The procedure of Example 1 was repeated, except that 4 parts of the polyethylene "A", as the ethylene-based olefin polymer, was replaced by 9 parts of the polyethylene "E" having the physical properties as indicated in Table 3, to obtain a toner resin composition (x) and a toner (X).

Example 7

The procedure of Example 1 was repeated, except that the polyethylene "A", as the ethylene-based olefin resin, was replaced by a polyethylene "F" having the physical properties as indicated in Table 3, to obtain a toner resin composition (xi) and a toner (XI).

Example 8

The procedure of Example 1 was repeated, except that 4 parts of the polyethylene "A", as the ethylene-based olefin polymer, was replaced by 9 parts of the polyethylene "F" having the physical properties as indicated in Table 3, to obtain a toner resin composition (xii) and a toner (XII).

Comparative Example 5

The procedure of Example 1 was repeated, except that 4 parts of the polyethylene "A", as the ethylene-based olefin polymer, was replaced by 9 parts of the polyethylene "G" having the physical properties as indicated in Table 3, to obtain a toner resin composition (xiii) and a toner (XIII).

Comparative Example 6

The procedure of Example 1 was repeated, except that 4 parts of the polyethylene "A", as the ethylene-based olefin polymer, was replaced by 2 parts of the polyethylene "H" having the physical properties as indicated in Table 3, to obtain a toner resin composition (xiv) and a toner (XIV).

Comparative Example 7

The procedure of Example 1 was repeated, except that the polyethylene "A" was replaced by a polypropylene ("660P", manufactured by Sanyo Chemical Co., Ltd.) having the physical properties as indicated in Table. 3,. to obtain a toner resin composition (xv) and a toner (XV).

The toners (VIII)–(XV) obtained in the above Examples 4–8 and Comparative. Examples 5–7 were evaluated for fixability, offset resistance and storage stability, according to the following test procedures. Results are given in Table 4.

(1) Fixability

Fixability evaluation was performed in the same manner as in Example 1.

(2) Offset resistance

Evaluation of offset resistance was performed in the same manner as in Example 1.

(3) Storage stability 20 g of each toner was loaded in a 200 cc sample bottle which was subsequently left to stand for 48 hours in a constant temperature bath controlled at 50° C. The toner was then sieved at a vibrational amplitude of 1 mm for 10 seconds by using "POWDER TESTER MODEL PT-E" manufactured by Hosokawa Micron Co., Ltd. If the amount of toner stayed on a 250 μm mesh screen was within 1 g, a rating of "O" (pass) was given to such a toner. If it exceeded 1 g, a rating of "X" (fail) was given to such a toner.

TABLE 3

| SAMPLE DESIGNATION | Mw | MELT VISCOSITY at 120° C. (cps) | M.P.* (°C.) | $W_1/W_2$ |
|---|---|---|---|---|
| D | 670 | 10 | 98 | 1.5 |
| E | 430 | 6 | 78 | 1.1 |
| F | 1500 | 960 | 105 | 2.3 |
| G | 2200 | 1800 | 120 | 0.9 |
| H | 350 | 2 | 60 | 0.9 |

*DSC-DETERMINED MELTING POINT

TABLE 4

| | NON-OFFSET TEMP. REGION (° C.) | NON-OFFSET TEMP. RANGE (° C.) | FIXED STRENGTH (%) 150° C. | FIXED STRENGTH (%) 170° C. | STORAGE STABILITY |
|---|---|---|---|---|---|
| Exp. No. | | | | | |
| 4 | 140–210 ↑ | 70 ↑ | 69 | 86 | ○ |
| 5 | 140–210 ↑ | 70 ↑ | 72 | 88 | ○ |
| 6 | 140–210 ↑ | 70 ↑ | 75 | 90 | ○ |
| 7 | 140–210 ↑ | 70 ↑ | 67 | 84 | ○ |
| 8 | 140–210 ↑ | 70 ↑ | 70 | 92 | ○ |
| COMP. Exp. No. | | | | | |
| 5 | 155–210 ↑ | 55 ↑ | — | 77 | x |
| 6 | 145–200 | 55 | 64 | 75 | ○ |
| 7 | 145–210 ↑ | 65 ↑ | 61 | 78 | ○ |

("↑" REPRESENTS "or HIGHER")

As described above, the toner resin composition and the toner of the present invention, if formulated properly, exhibit excellent fixability, offset resistance and storage stability, as well as reduced degrees of DF staining.

What is claimed is:

1. A toner resin composition including:

(a) a vinyl copolymer containing 25 or lower % by weight of molecular species having molecular weights of 200,000 or higher; and (b) 3 to 10% by weight of polyethylene having a DSC-determined peak (melting point) within a range of 85–100° C., a weight average molecular weight (Mw) within a range of 500–900, a number average molecular weight (Mn) within a range of 500–900, and a melt viscosity of 10 to 17 cps at 100° C.

2. The toner resin composition of claim 1, wherein said vinyl copolymer is prepared principally from a styrene monomer and a (meth)acrylic ester monomer.

3. A toner prepared principally from a colorant and the toner resin composition of claim 1.

4. A toner resin composition including:

(a) a vinyl copolymer prepared principally from a styrene monomer and a (meth)acrylic ester monomer; and (b) 3 to 10% by weight of an polyethylene having a DSC-determined peak (melting point) within a range of 75–110° C., a weight average molecular weight (Mw) within a range of 400–2,000, a melt viscosity in the range of 5–1,000 cps at 120° C. and a thermal property as defined by $W1/W2 \geqq 1$ wherein W1 is an endothermic heat accompanying its fusion in the temperature region ≧Tm, W2 is an endothermic heat accompanying its fusion in the temperature region <Tm and Tm is said DSC-determined peak.

5. A toner prepared principally from a colorant and the toner resin composition of any one of claims 1, 2 or 4.

* * * * *